United States Patent [19]

Grohmann

[11] 4,196,053

[45] Apr. 1, 1980

[54] EQUIPMENT FOR OPERATING COKE OVEN SERVICE MACHINES

[75] Inventor: Klaus Grohmann, Kaarst, Fed. Rep. of Germany

[73] Assignee: Hartung, Kuhn & Co. Maschinenfabrik GmbH, Dusseldorf, Fed. Rep. of Germany

[21] Appl. No.: 839,329

[22] Filed: Oct. 4, 1977

[51] Int. Cl.[2] ..... C10B 25/12; C10B 33/14; C10B 39/14

[52] U.S. Cl. ..... 202/227; 202/248; 202/263; 414/152

[58] Field of Search ..... 202/227, 262, 263, 248, 202/242; 201/39; 214/18 R, 41 R; 105/238 R, 241 R, 241 C

[56] References Cited

U.S. PATENT DOCUMENTS

| | | | |
|---|---|---|---|
| 3,675,400 | 7/1972 | Kubsch | 202/263 X |
| 3,676,305 | 7/1972 | Cremer | 202/263 |
| 3,715,282 | 2/1973 | Pries et al. | 202/263 |
| 3,729,384 | 4/1973 | Kinzler et al. | 202/263 |
| 3,809,622 | 5/1974 | Knappstein et al. | 202/263 |
| 3,970,526 | 7/1976 | Bender et al. | 202/230 X |
| 4,051,960 | 10/1977 | Raksanyi | 105/241 C X |
| 4,069,108 | 1/1978 | Riecker | 202/263 |

*Primary Examiner*—Arnold Turk

*Attorney, Agent, or Firm*—Dressler, Goldsmith, Clement, Gordon & Shore, Ltd.

[57] ABSTRACT

A hood car having a hood, a coke guide, a coke guide car, and a quench train are all provided for movement parallel to a battery of chamber coke ovens between a quench plant and the ovens. The hood car hood has an opening reaching over the loading area of the quench train and is adapted to be connected through extraction ducts to a gas transition device which is movable on a stationary collection duct alongside the coke oven battery and which has an opening at the top. The opening can be sealed by a flexible cover belt which can be lifted off by the gas transition device. The collection duct is connected to a stationary extraction and purifying device which purifies the dirty gases. The movable hood car and the quench train have coupling means, functional in both directions of movement, for coupling together the hood car and the quench train. The hood car has a brake means for automatically stopping the car upon being uncoupled from the quench train. According to the method of the present invention, the quench train is moved to the quench plant with the hood covering the quench train. Before the train enters the quenching plant, the hood is uncoupled and is automatically braked until it comes to rest. The hood is recoupled to the quenching train as soon as the quenching train has moved out of the quenching plant and has moved under the hood.

4 Claims, 20 Drawing Figures

EQUIPMENT FOR OPERATING COKE OVEN SERVICE MACHINES

BACKGROUND OF THE INVENTION

The invention relates to a process for operating coke oven service machines on the coke side of a battery of coke oven chambers having vertical heating flues and for simultaneously collecting, extracting and purifying the dust-containing mixtures of gas and air which arise on pushing out and transporting fully carbonized, red-hot coke from oven chambers of the coke oven to a quenching plant and sometimes on transferring the quenched coke to the ramp. In such a process, the red-hot coke is pushed out, by means of a coke pushing machine which is movable on the pressure side of the oven battery, through a coke guide with a closed top and through a hood, which is sealed against the coke guide, onto a quench train which is covered by the hood, and the dirty gases which originate from the coke and rise in the coke guide and in the hood are continuously sucked through a collecting duct into a stationary extracting and purifying device and are purified in the latter.

In the case of coke oven batteries which are provided, on the coke side, with a door lifting car or coke guide car, and with a quench train and a hood reaching over the quench train, it is known to draw through the hood the gas/dust emissions which are produced when pushing the coke out of the oven chambers of the coke oven battery. However, the air pollutants, which arise during the transport of the red-hot coke to the quenching plant and from the quenching plant to the coke ramp, are, as a rule, not collected. In general, this is only possible by completely encasing the coke side of the coke oven battery on the line up to the quenching plant or by complicated modifications to the quench car and by expensive equipment, such as, for example, attached mobile washer cars which have the disadvantages of being difficult to maintain and having high space requirements, high wheel loads and a limited extraction capacity.

By contrast, it is the object of the invention completely to collect and purify the dust-containing mixtures of air and gas which arise on the coke side when pushing the coke out onto the quench train and on transporting the latter to the quenching plant.

SUMMARY OF THE INVENTION

According to the invention, this object is achieved when a freely movable car carrying the hood is coupled to a quench train and the quench train, together with the hood covering it, is moved parallel to the coke oven to the quenching plant. The hood is uncoupled from the quench train shortly before the train enters the quenching plant, and the car is automatically braked until it comes to rest. As soon as the quench train, after leaving the quenching plant, has moved under the hood, the hood is recoupled to the quench train. In this way, the quench train, at least while moving to the quench plant, is covered by the hood and is always connected to the stationary extracting and purifying device.

Moreover, it is advisable also to collect and extract the vapors of quenching steam which arise from the quenched coke when the quench train is moved from the quenching plant up to the coke ramp onto which the quenched coke is to be discharged. For this purpose, the quench train, together with the hood covering it, is moved to the coke ramp after the coke has been quenched.

If the hood is also moved to the quenching plant and back to the ramp, this has the great advantage that the emissions from the red-hot and quenched coke can be completely collected and purified, using a conventional quench train. The disadvantages of completely encasing the coke side are eliminated in this way along with very expensive and rather unreliable modifications of quench cars into mobile washer cars. The disadvantages, inter alia, have deleterious effects on the workman, which effects are caused by poisonous gases, coke particles raining down and a general deterioration of the working conditions.

The equipment for carrying out this process according to the invention comprises a car with a hood, or hood car, a coke guide car and a quench train, all of which are movable parallel to a battery of chamber coke ovens with vertical flues and on the coke side thereof. The hood of the hood car is provided with an opening which reaches over the loading area of the quench train so that is is possible to connect the car hood, together with a hood covering the coke guide, via one extraction duct in each case to a gas transition device which is movable on a stationary collection duct laid alongside the coke oven battery. The duct has a passage opening, provided at the top, which can be sealed by a flexible cover belt which can be lifted off, by means of the gas transition device leading to the collection duct, for the particular part of its length which is connected to a stationary extracting and purifying device. It is possible, according to the invention, that the freely movable hood car can, in both directions of motion, be coupled to the quench train and moved. In the uncoupled state the hood car can be automatically stopped in its particular position.

In a further modification of this equipment, it is advisable to provide, in front of the quenching plant, a stationary unlocking device which interacts with a control member of the coupling device for coupling the quench train to the hood car so that the hood car is necessarily separated from the quench train. It is advisable to arrange this in such a way that a coupling element vents or releases a breaking system when the quench train is coupled to the hood car, the braking system being moved automatically into the braked position by means of a pre-tensioning element when the coupling is released.

To provide for a suitable seal between the hood and the coke guide, it is possible that an opening of the hood mounted on the hood car and interacting with the coke guide, can be closed by doors which, in their open position, make sealing contact, by means of seal elements, with an extension of the coke guide. In this case, a control device for the doors of the opening of the hood and interacting with the coke guide, can be mounted on the coke guide car and carry a runner for actuating roller levers on the end of door journals which enables the hood to be separated from the coke guide, in the direction of motion thereof, when the control device is in its extended position. The roller levers of the doors can be connected to counterweights by means of connecting rods or chains in such a way that the doors are closed during the motion of the hood car.

BRIEF DESCRIPTION OF THE DRAWINGS

The invention is illustrated, by way of example, and diagrammatically in the drawings in which.

DESCRIPTION OF THE PREFERRED EMBODIMENT

Figure 1A:
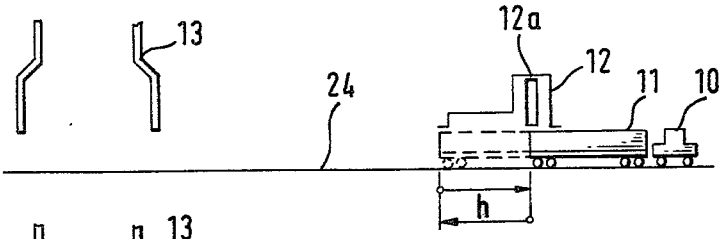
FIG. 1 is a schematic diagram illustrating the paths of motion, relative to a quenching plant, of a quench train consisting of the quench car, a quench locomotive, and a movable hood which always covers the quench car while it is outside the quenching plant.

FIG. 1 shows a schematic representation of a quench train, consisting of a quench locomotive 10 and a quench car 11 coupled thereto, and a hood 12 which reaches over the loading area of the quench car and has a passage opening 12*a* for the red-hot coke. These three service machines 10, 11 and 12 are movable to a quenching plant 13, parallel to the plane of the drawing.

FIGS. 1*a* to 1*g* clearly show 7 different operating stages. FIG. 1*a* shows the position of the quench locomotive 10 and car 11 at the start of the coke pushing process. At this stage, the end of the quench car 11, facing away from the quench locomotive 10, is underneath the passage opening 12*a* for the red-hot coke.

While the red-hot coke is pushed out of the oven chamber of a chamber coke oven with vertical flue, the quench car 11 is moved the distance "h" by means of the quench locomotive 10 so that, in the position shown in dashes, the quench car is completely under the hood 12 at the end of the coke pushing process.

Figure 1B:
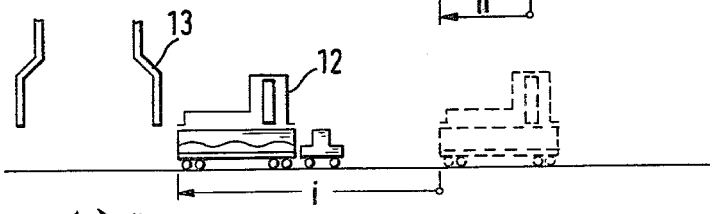
Figure 1C:
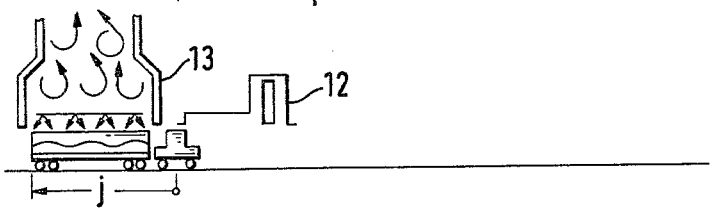

As soon as the red-hot coke has been completely pushed out of an oven chamber and into the quench car 11, the hood 12 is coupled to the quench locomotive 10 so that the hood 12, in its position for collecting the dust-containing gases which rise from the red-hot coke in the quench car 11, can be moved together with the quench train the distance "i" from the end position shown in FIG. 1*a* into the end position shown in FIG. 1*b*, in front of the quenching plant 13. According to FIG. 1*b*, the hood 12 is uncoupled from the quench car 11 and held on the spot by an arrester brake, as will be described in detail later on. Thereafter, the quench car is moved a distance "j" by the quench locomotive 10 under the quenching plant 13, for example a quenching tower, so that the coke which is on the quench car can be quenched as illustrated in FIG. 1*c*. At this stage, the quench locomotive also moves under the hood 12.

Figure 1D:
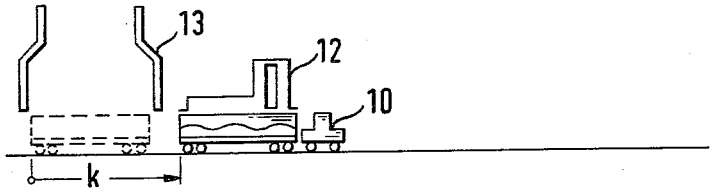
Figure 1E:
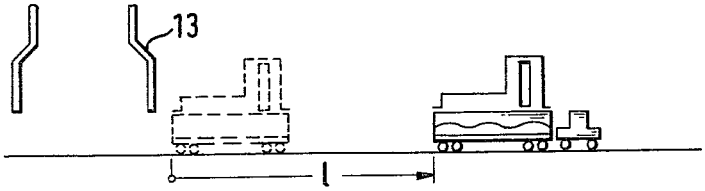
Figure 1F:
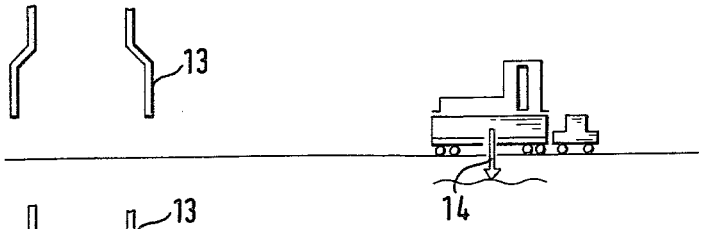
Figure 1G:
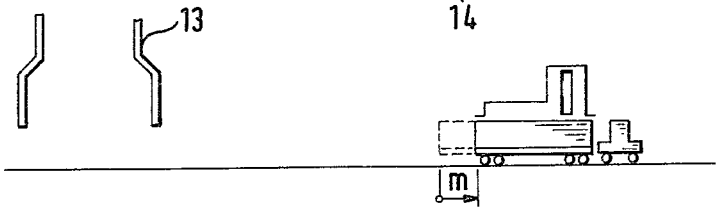

After the coke has been quenched, the quench car 11 is moved back, according to FIG. 1*d*, under the hood 12, the distance "k" which corresponds to the distance "j". The hood 12 is coupled to the quench locomotive 10 and is then moved, in this position coupled to the quench train, into the operating position according to FIG. 1*e* by a distance "l" which corresponds to the distance "i" in FIG. 1*b*. According to FIG. 1*f*, the quenched coke is unloaded in this position onto a ramp, represented by arrow 14. The hood 12 and the quench car 11, with the car 11 in the position covered by the hood 12, are then moved by the quench locomotive 10 by a distance "m" (FIG. 1*g*) to the next oven to be emptied. There, the above-described procedure begins again according to FIG. 1*a*.

According to the invention, the advantage of continuously covering the quench car by the hood, until the movement to the coke ramp has ended, is thus achieved. The steam given off by the quenched coke is collected during the movement to the ramp and is extracted via the stationary de-duster. This results in greater safety in operation in winter, in particular in cold climates, since the steam in the form of mist cannot obscure the view on the coke side. Furthermore, a higher degree of protection from emissions is obtained.

Figure 2A:
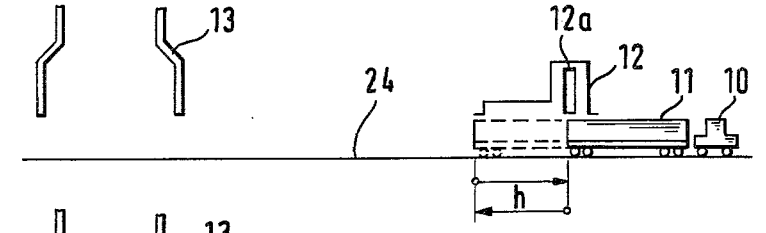
FIG. 2 shows a diagram similar to FIG. 1, the quench car being moved to the coke ramp with the hood but without being covered by the hood.
Figure 2B:
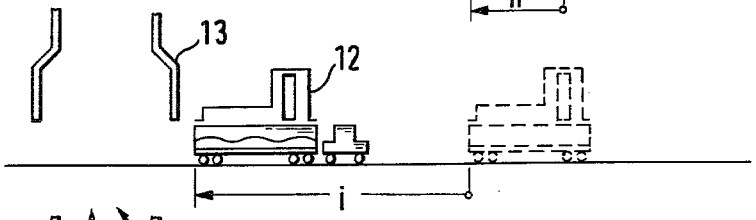
Figure 2C:
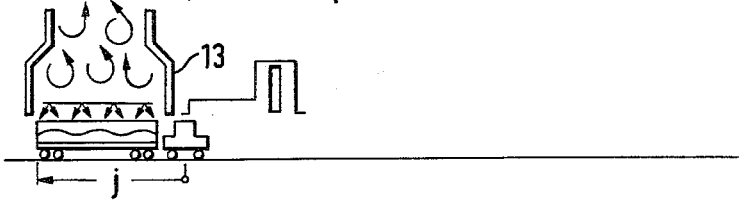
Figure 2D:
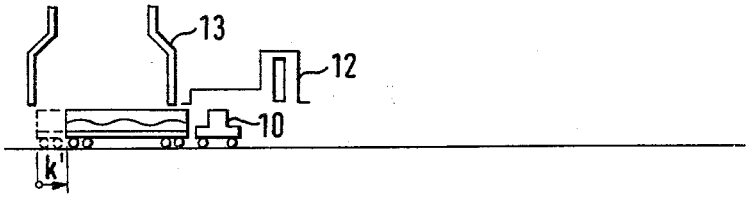
Figure 2E:
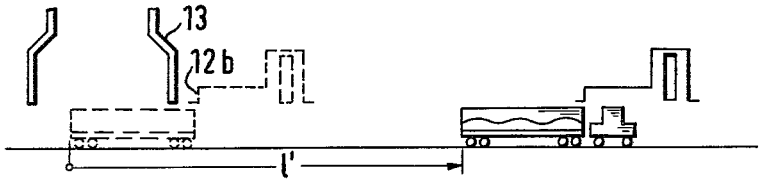
Figure 2F:
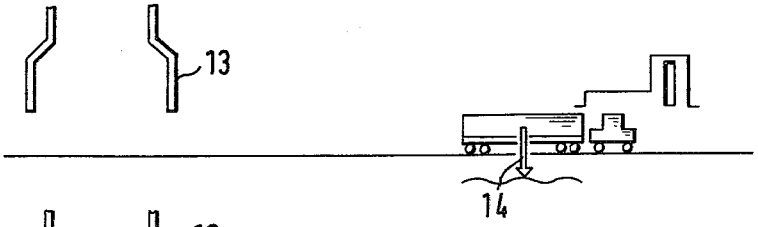
Figure 2G:
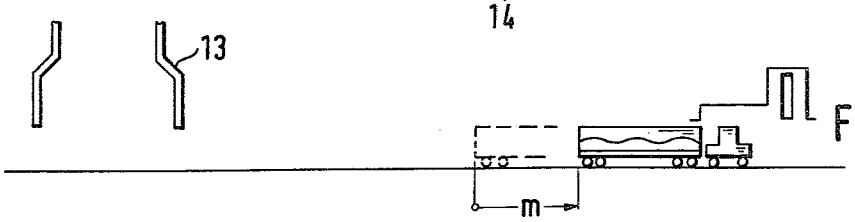

In the modified procedure which is illustrated in the diagram according to FIG. 2, the process steps in FIGS. 2*a*, 2*b*, and 2*c* are the same as in FIGS. 1*a*, 1*b*, and 1*c*. However, the process steps in FIGS. 2*d* to 2*g* differ from the process steps shown in FIGS. 1*d* to 1*g* in that, after the red-hot coke has been quenched under the quenching plant 13, the quench train is moved out from under the quenching plant 13 only by the distance "k'" in FIG. 2*d*, the distance "k'" being approximately such a distance that the front of the quench car 11, facing the hood 12, and the front 12*b* of the hood, facing the quenching plant 13, lie in approximately vertical registry, while only the quench locomotive 10 is under the hood 12. As soon as the quench train has reached the position shown in FIG. 2*d*, the hood 12 is coupled to the quench train and is moved, in the position relative to the quench train, shown in FIG. 2*d*, together with the train 10 by a distance "l'" to a coke ramp (FIG. 2*e*) where the coke is unloaded onto a ramp (not shown) represented by the arrow 14 in FIG. 2*f*. Subsequently, the quench train, together with the hood in the position shown in FIG. 2*g* (i.e., with the quench car 11 not covered by the hood 12) is moved by a distance "m" to the next oven to be emptied so that a new process cycle can be started there as illustrated in FIG. 2*a*. Thus, it can be seen that in this case, the quenching fumes which rise from the quenched coke on the quench car 11 after quenching are released into the open atmosphere and are not collected, and thus, are not prevented from passing into the open atmosphere by the hood 12 which is always connected to the extracting and purifying device.

As will be explained later, the coupling procedures for connecting the car carrying the hood to the quench train and for separating them from one another can be carried out automatically, and a special safety arrangement is additionally provided which ensures, under all circumstances, that the collecting hood is uncoupled from the quench train or the quench locomotive and stopped before the quench train moves into the quenching plant.

Figure 4:
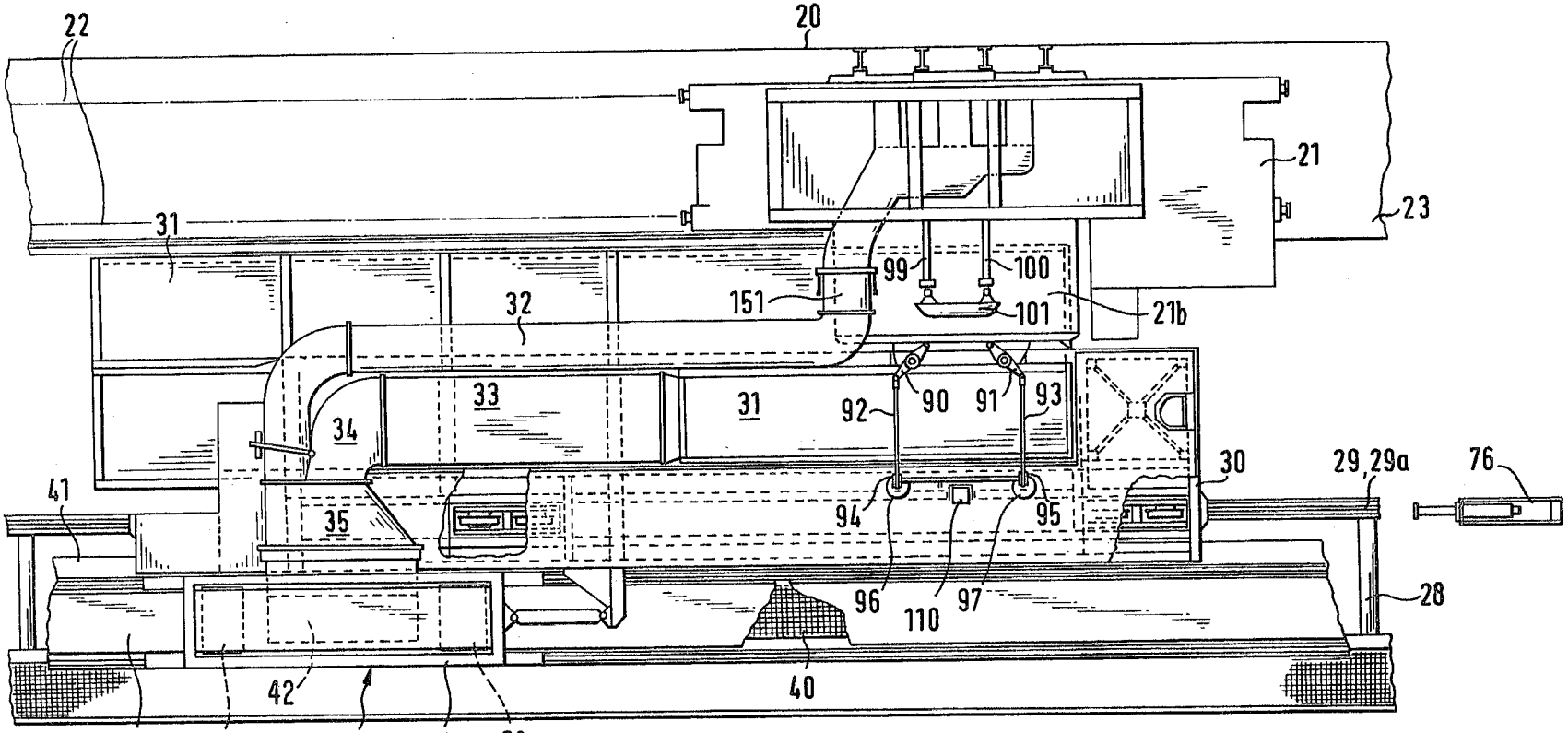
FIG. 4 shows a plan view of the equipment.
Figure 5:
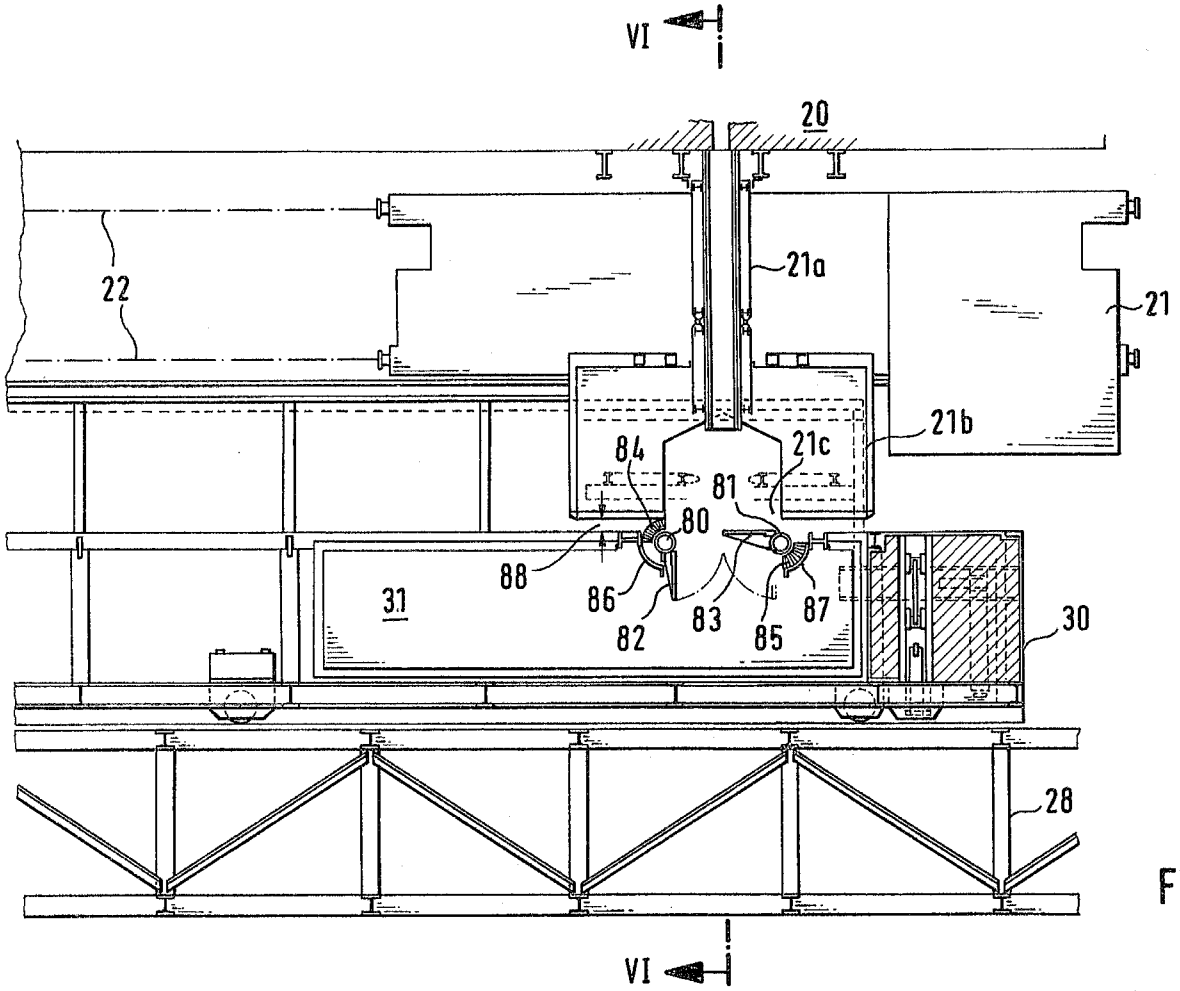
FIG. 5 shows a section taken generally along the line V—V in FIG. 6.
Figure 6:
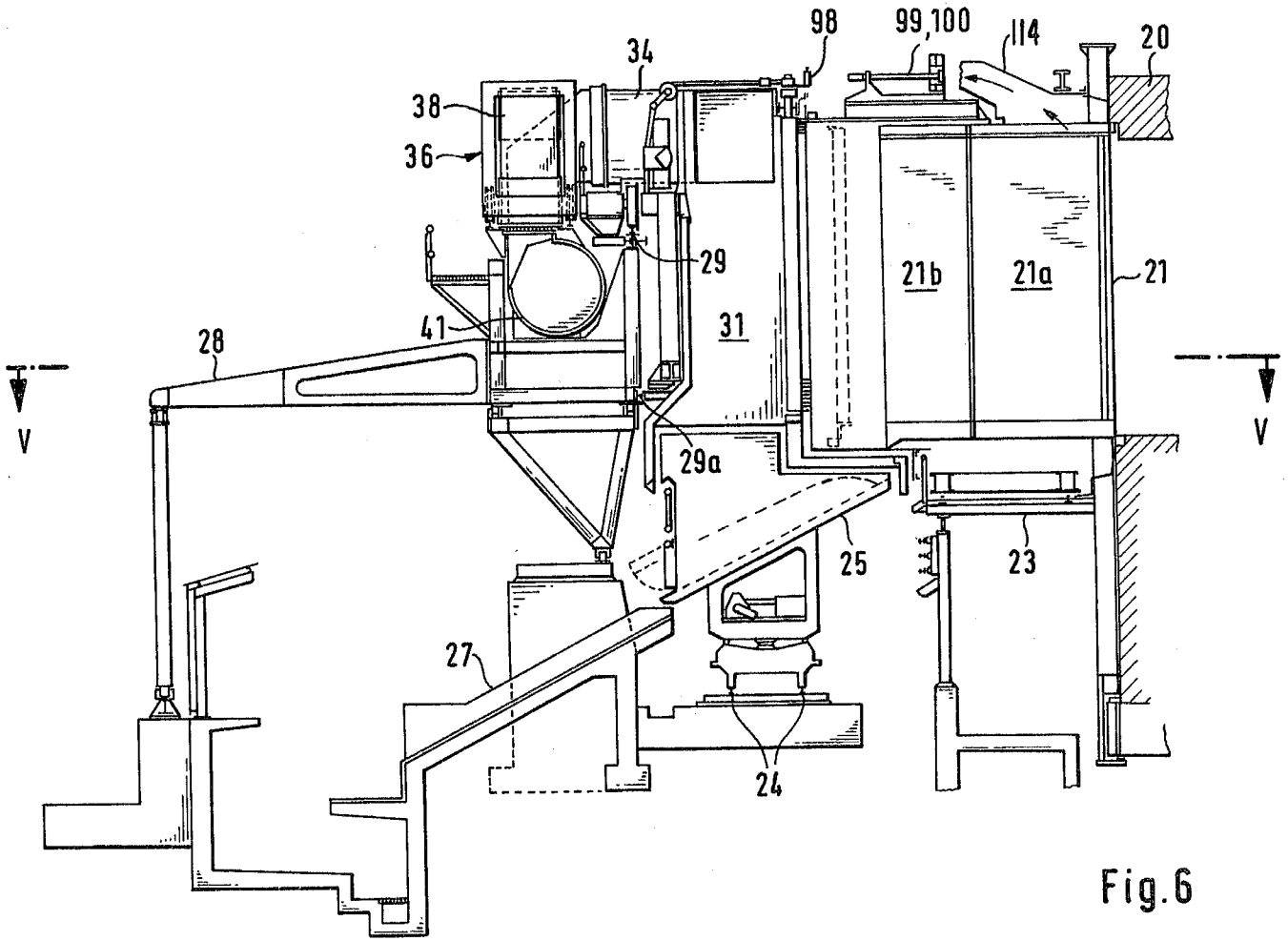
FIG. 6 shows a cross section through the equipment taken generally along the section line VI—VI in FIG. 5.

FIGS. 4, 5, and 6 show a battery 20 of chamber coke ovens with vertical flues, in front of which a coke guide car 21 is movable on rails 22 laid on a gas gallery 23. A quench car 25 and a quench locomotive 26 which can be coupled to one another in the customary manner are movable on a track 24 in front of the coke guide car. On the side of the quench car, facing away from the coke oven battery, there is a coke ramp 27. On the stationary bridge structure 28, a hood car 30 carrying a hood 31, the lower extraction opening of which reaches over the loading area of the quench car 25, is movable on rails 29, 29a which are in a spaced arrangement above one another in a substantially vertical plane.

According to FIGS. 4 and 6, the top of the coke guide 21a, via an extraction duct 32, and the hood 31, via a regenerator 33 and an extraction duct 34 adjacent thereto, are connected to a collection header 35 which can be connected to a gas transition car 36. This gas transition car consists of a closed housing 37 in which a flexible, heat-resistant cover belt 39 runs over guide wheels 38 in such a way that the particular section of the length of the flexible belt 39, which is under the gas transition car 36, is lifted off by an upper longitudinal opening 40 of a collection duct 41, thus forming a passage opening 42 through which the dirty gases, rising in the coke guide 21a and in the hood 31, can be passed into the collection duct 41 and through the latter into a purifying device, for example, a scrubber.

Figure 3:
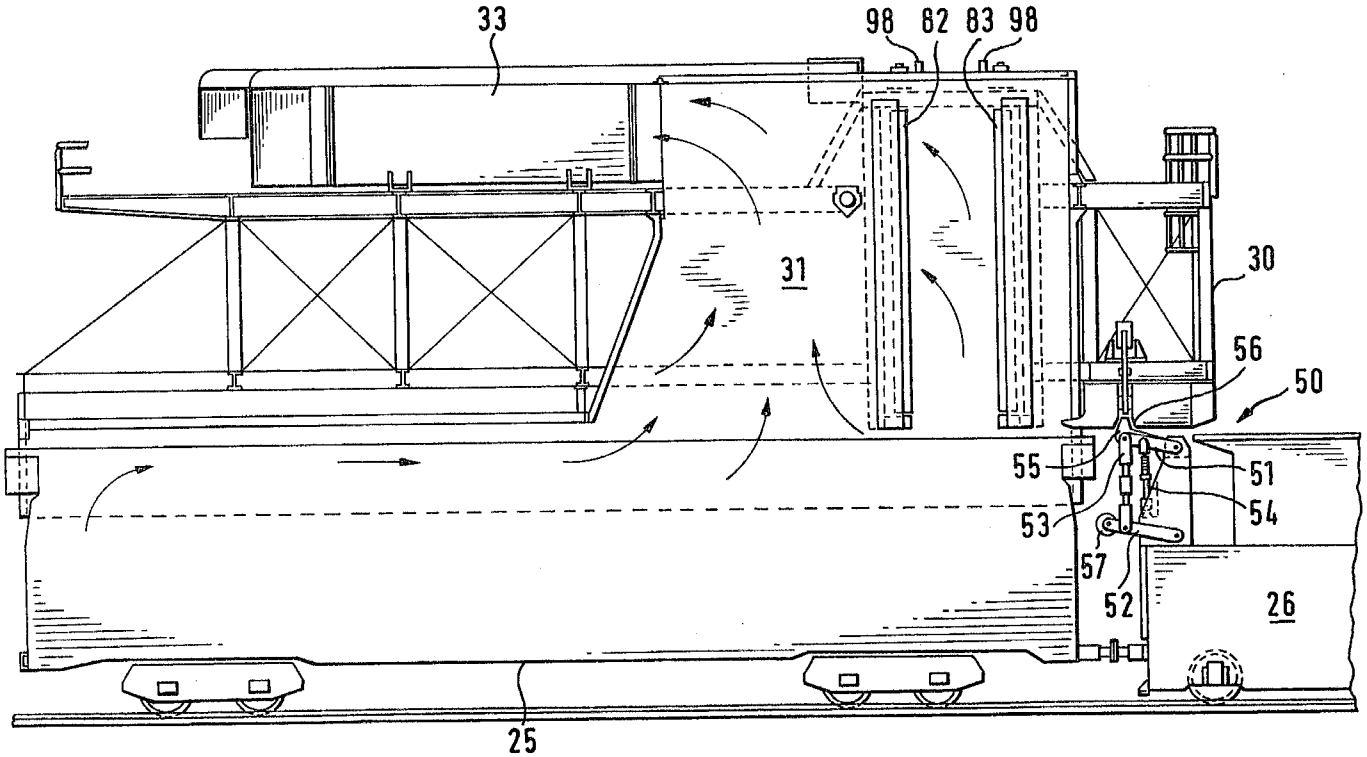
FIG. 3 shows a partial side view of the hood and the quench train from the side of the coke oven battery.
Figure 7:
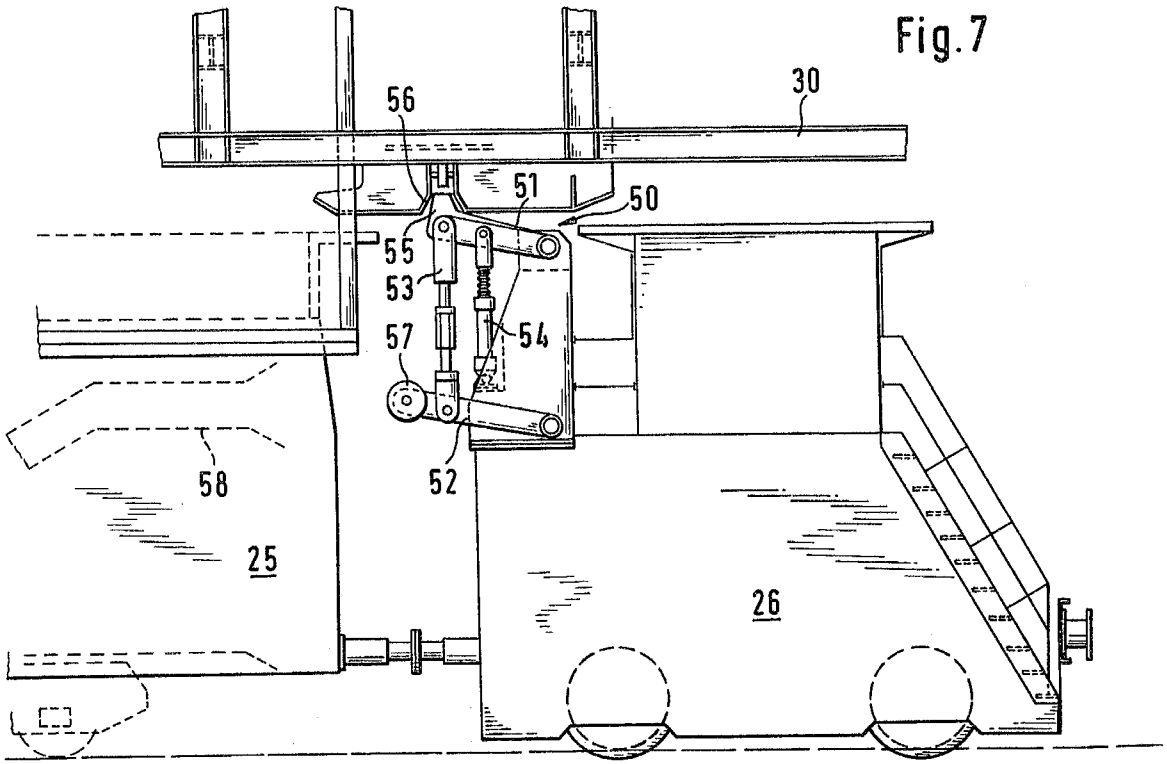
FIG. 7 shows a view of the coupling device on the quench locomotive in an enlarged representation, with a control cam for forced uncoupling.
Figure 8:
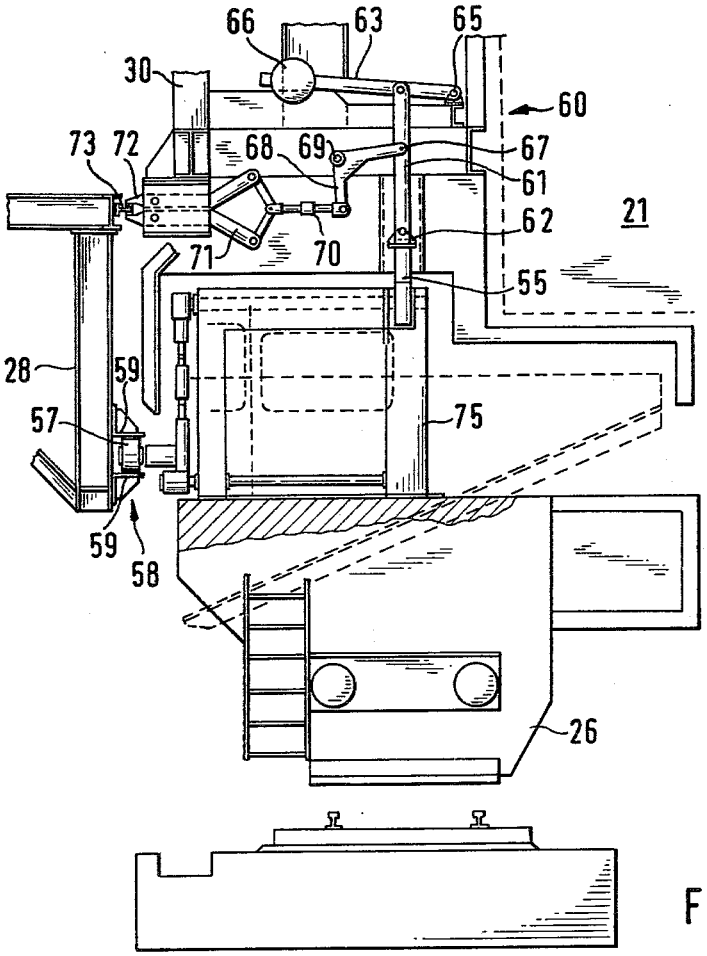
FIG. 8 shows a front view of the coupling device on the quench locomotive and of the arrester brake on the hood car.

FIGS. 3, 7 and 8 show a coupling device 50, by means of which the hood car 30 can be coupled to the quench locomotive 26 in such a position that the hood 31 then reaches exactly over the quench car 25 so that the dirty gases which rise into the hood in accordance with the arrows shown in the drawing can be extracted through the regenerator into the collection duct 41, while the quench car, together with the hood car 30 and the hood 31 which reaches over the quench car, is moved by the quench locomotive 26, as was described above.

In detail, the coupling device 50 consists of a parallelogram hinge with two short levers 51 and 52, which are hinged to the locomotive. The ends of the levers 51 and 51 are coupled by a hinged rod or joints 53 of adjustable length. An electrical thrustor or pneumatic cylinder 54 is hinged on one end to the quench locomotive 26 and is engaged on the other end with the lever 51. The upper short lever 51 also has a coupling element 55 which engages with the underside of the hood car 30 in a tapered opening 56 for coupling, in order to effect coupling.

A support 75 carrying the coupling device 50 is advantageously designed as a gantry so that the driver of the quench locomotive can see the dropping coke.

The free end of the lower short lever 52 projects beyond the hinge point of the hinged rod 53 and is provided with a cam roller 57 which can rotate about a horizontal axis and which protrudes laterally and outwardly from the short lever 52 and interacts with a control cam 58 (FIG. 7) which is formed by flat rails 59 which face one another at a distance and are fixed to the stationary bridge structure 28. In the region in front of the quenching plant 13, this control cam 58 is arranged in such a way that, if the control device 54 is not actuated, the cam roller 57 is necessarily forced into the control cam 58 and the coupling element is thus pulled out of the opening 56 for uncoupling the hood car 30.

To prevent a further free motion of the hood car, the latter is provided, according to FIG. 8, with a braking system which is generally designated as 60 and which interacts with the coupling device 50 in such a way that, in the coupled state, the coupling device vents or releases the braking system of the hood car while, in the uncoupled position of the coupling device 50, the braking system immediately becomes automatically effective or engaged. More specifically, the braking system consists of a control rod 61, having a lower end hinged to a rod plate 62. The lower surface of plate 62 interacts with the coupling element 55 of the coupling device. The upper end of the control rod 61 is hinged to a weight lever 63 which is mounted on the hood car so that it can pivot about a horizontal axis 65 and which carries a brake weight 66 at its outer end. An angled lever 68, which is mounted so that it can pivot about a horizontal axis 69 on the hood car, flexibly engages with the control rod 61 intermediate of its ends at the hinge point 67. The other end of the angled lever 68 is jointed to a hinged rod 70 which in turn is connected to brake claws 71. The claws 71 have brake shoes 72 which can engage a horizontal brake rail 73 which is rigidly joined to the stationary bridge structure 28.

It can be seen that, when the coupling element 55 engages the opening 56 for coupling the hood car (FIG. 7), the coupling element 55 hits the underside of the rod plate 62 and moves the latter, with the control rod 61, upwardly against the action of the weight 66 so that the angled lever 68 is pivoted counterclockwise (as viewed in FIG. 8) about the pivot axis 69 so that the brake claws 71 and shoes 72 are thus opened. If however, due to the control device 54 having been actuated, or due to the control action of the control cam 58 on the cam roller 57 (FIG. 7) the control element is pulled out of the hood car coupling opening 56, the control rod 61 is forced downwardly by the brake weight 66 so that the angled lever 68 is now pivoted clockwise (as viewed in FIG. 8) and the brake claws 71 and shoes 72 are thus closed relative to the brake rail 73 by means of the hinged rod 70 so that the hood car 30 is arrested in its position.

A limit switch locking mechanism (not shown) is mounted on the quench locomotive 26 and serves to recouple the hood car 30 to the quench locomotive 26. This locking mechanism has the effect that the coupling device 50 can only be moved out upwardly after a limit switch mounted on the quench locomotive 26 has been actuated. This actuation of the limit switch takes place by means of an element which is mounted on the hood car and which actuates the limit switch only if the coupling device of the quench locomotive is in the correct position opposite the hood car.

According to FIGS. 4 and 5, approximately one-third of the coke guide 21a protrudes into an extension 21b. The side of the extension 21b faces the hood 31 and is aligned parallel to an opposite wall of the hood. On the side facing the coke guide car 21, the hood car 30 carries, on each of the vertical door journals 80 and 81, a door 82 and 83, respectively, by means of which it is possible to close an opening 21c in the hood 31, which opening faces the coke guide and approximately corresponds to the free cross section thereof. In FIG. 5, the door 83 is shown in the closed position and the door 82 is shown in the open position. Steel brushes 84, 85 which extend over part of a cylindrical cross section and over the entire height of the door opening and which, both in the closed position and in the open position of the doors 82 and 83, make at least partially sealing contact with sheets 86 and 87 of cylindrical section, are connected to the vertical door journals 80 and 81 respectively, which journals are designed as tubes. In the open position of the doors, the brushes thus bridge a gap 88 opposite the extension 21b of the coke guide car and are in substantially tight contact with the wall thereof in the region of the opening 21c.

The elasticity of the brush seal between the hood and the extension of the coke guide makes it possible to compensate for irregularities in the rails of the track for the coke guide car on the one hand and of the track for the hood car on the bridge structure on the other hand.

As can be seen from FIGS. 4 and 6, roller levers 90 and 91 are fastened to the upper ends of the two door journals 80 and 81 respectively. Counterweights 96 and 97, which are vertically guided on the hood car on the side opposite opening 21*c*, are in engagement with the roller levers 90 and 91 respectively, via flexible pulling elements 92 and 93 respectively, which pulling elements run over guide rollers 94 and 95 respectively, which guide rollers are fixed on the hood car 30.

The other ends of the roller levers 90 and 91 are each provided with an actuating pin 98 (FIG. 6) which can be engaged, against the action of the counter-weights 96 and 97 by a control actuating runner or cam 101 (FIG. 4), which is connected to two control devices 99 and 100, respectively, to open the two doors 82 and 83. The control devices 99 and 100 are mounted on the extension 21*b* of the coke guide 21*a*, so that they can move horizontally. They can consist of, for example, hydraulic piston/cylinder units. The actuation of the doors by the actuating cam or runner 101 located on the coke guide car also allows large positioning tolerances in the direction of movement of the hood car and the coke guide car and further allows a separation in the direction of movement when the control devices 99 and 100 are extended, without the risk of failure.

In FIG. 4, it is also possible to see a gamma ray source 110 which is mounted on the hood car 30 on the side of the hood 31 facing away from the oven. A shutter (not shown) could be connected to the counterweights 96 and 97 in such a way that when the hood doors 82 and 83 are opened, the shutter would simultaneously open the path for the gamma rays from the source 110 so that the gamma rays would freely pass through the oven up to the pushing machine (which is movable on the opposite side of the coke oven battery), and there strike a receiver device which could be connected in a system to lock the coke guide car, the hood car and the pushing machine in their relative positions by means of, for example, electrical actuation of the brakes associated with these machines (not shown).

In order to reduce the load on the brake for the hood car, it is advisable to provide two solid state limit switches (not shown) for the quench locomotive in the vicinity of the quenching plant, which switches are located at a certain distance from one another in the direction of motion of the quench locomotive. The first limit switch makes it possible to automatically reduce the maximum speed of the quench locomotive to a minimum speed. The quench locomotive is completely stopped when the second limit switch is reached. If in case of failure of the switches, when the quench locomotive reaches and passes the stopping point in automatic operation, the roller 57 (fitted on the coupling device 50 and previously described) engages the stationary cam 58 so that the hood car 30 is necessarily uncoupled from the quench locomotive 26. In this forced uncoupling, the hood car 30 is braked until it comes to rest by means of the brake weight 66 of the rail brake. If the rail brake should also fail, long stroke hydraulic bumpers 76 are located at either end of the bridge structure (FIG. 4).

The connection of the extractor installation 114, provided above the coke guide 21*a*, to the extraction duct 32 is effected by a telescopic tube 151 (FIG. 4) which is coaxially adjustable, so as to make a seal, relative to a branch of the collection duct 32 by means of a hydraulic cylinder via a lever.

As can be seen from the drawings, the center of gravity of the entire hood car 30, supported by the bridge structure 28, is located between the rails of the quench car 25 approximately above the coupling device 50 so that the hood car and the quench car can be moved by means of the quench locomotive 26 without so-called "tilting moments" of a significant magnitude acting on the quench locomotive or on the hood car. It is thus possible to move the quench car, in a state covered by the hood, up to the quenching plant and back again without having to equip the hood car itself with a drive. The hood car can be largely kept free from control devices or drive motors of any type so that its maintenance requires little effort and so that its susceptibility to failure is very small and so that maximum reliability in operation is thus achieved. All the necessary control actions are triggered, or monitored by control systems, from the coke guide car or from the quench locomotive.

What is claimed is:

1. Equipment for operating coke oven service machines between a quenching plant and the coke side of a battery of coke oven chambers having vertical heating flues and for simultaneously collecting, extracting, and purifying dirty dust-containing mixtures of gas and air, said equipment comprising:

a coke guide car and a coke guide mounted thereon, said coke guide car movable parallel to said battery of coke oven chambers on the coke side thereof;

a quench train having a coke loading region movable parallel to said battery of coke oven chambers on the coke side thereof;

a hood car movable forward and backward along said battery of coke oven chambers and having a hood, said hood of said hood car adapted to extend over said loading region of the quench train and having a hood opening adapted to communicate with said quench train;

a stationary gas collection duct alongside said battery of coke oven chambers and a gas transition car movable thereon, said stationary gas collection duct having a duct opening at the top and sealed by a flexible cover belt which can be lifted off by said gas transition car, said duct opening providing communication between the interior of said collection duct and said gas transition car;

a first movable duct connecting said gas transition car and said coke guide;

a second movable duct connecting said gas transition car and said hood;

coupling means between said hood car and quench train functional in said forward and backward directions for coupling together the hood car and quench train and permitting movement thereof, said coupling means having a control member;

a stationary unlocking means provided in front of the quenching plant for interacting with said control member to separate the hood car from the quench train; and brake means on said hood car for automatically stopping its movement when the hood car is uncoupled from the quench train, said brake means including a means for automatically stopping the hood car in the braked position when said coupling means is released and for releasing said brake means when the quench train is coupled to the hood car.

2. The equipment in accordance with claim 1 in which said coke guide has an extension and further including a structure in said hood defining an opening communicating with the coke guide and having doors adapted for closing said opening, said doors having seal elements for sealingly engaging with said extension when the doors are open.

3. The equipment in accordance with claim 2 in which (A) said coke guide has a control device associated with each door, said control device having a retracted position and an extended position and including a runner cam and (B) said hood has rotatable journals, said doors being mounted on said journals, the ends of said journals having levers for being engaged by said runner cam to open said doors when said hood is adjacent said coke guide and said control device is in the extending position to engage said levers.

4. The equipment in accordance with claim 3 further including counterweights and connecting means joining said counterweights and said levers for rotating said levers to close said doors when said runner cam is disengaged from said levers.

* * * * *